US005152082A

United States Patent [19]

Culpepper

[11] Patent Number: 5,152,082

[45] Date of Patent: Oct. 6, 1992

[54] SHOE AND ANKLE SUPPORT THEREFOR

[76] Inventor: Thomas C. Culpepper, P.O. Box 13100, Chesapeake, Va. 23325

[21] Appl. No.: 807,249

[22] Filed: Dec. 16, 1991

[51] Int. Cl.[5] ..... A43B 7/20; A43B 7/14; A43B 7/18

[52] U.S. Cl. ..... 36/89; 36/88; 36/92; 36/114; 36/69; 602/27; 602/65

[58] Field of Search ..... 36/88, 89, 90, 92, 114, 36/68, 69; 602/27, 65

[56] References Cited

U.S. PATENT DOCUMENTS

| | | | |
|---|---|---|---|
| 325,280 | 9/1885 | Smadbeck et al. | 36/89 |
| 332,728 | 12/1885 | McEwen | 602/65 |
| 487,492 | 12/1892 | Pugsley | 36/89 |
| 522,371 | 7/1894 | Horn et al. | 36/89 |
| 555,328 | 2/1896 | Posner | 36/89 |
| 1,116,133 | 11/1914 | Schusheim | 602/65 |
| 1,192,433 | 7/1916 | Krieger | 36/90 |
| 1,522,256 | 1/1925 | Meyers | 36/89 |
| 1,548,172 | 8/1925 | Redden | 36/89 |
| 1,586,698 | 6/1926 | Posner | 36/89 |
| 1,692,896 | 11/1928 | Hilgert | 36/89 |
| 2,634,515 | 4/1953 | Saitta | 36/89 |
| 4,506,460 | 3/1985 | Rudy | 36/69 |
| 4,571,856 | 2/1986 | Lin et al. | 36/89 |
| 4,676,011 | 6/1987 | O'Rourke et al. | 36/89 |
| 4,908,963 | 3/1990 | Krajeir et al. | 36/77 R |
| 4,947,560 | 8/1990 | Fuerst et al. | 36/88 |
| 4,989,350 | 2/1991 | Bunch et al. | 36/89 |

*Primary Examiner*—Paul T. Sewell
*Assistant Examiner*—Marie D. Patterson
*Attorney, Agent, or Firm*—Beveridge, DeGrandi & Weilacher

[57] ABSTRACT

A shoe is provided with an ankle support member to reduce the risk of ankle injury. The ankle support member is a stiff resilient piece of bendable sheet material including a base portion, and a plurality of lateral and medial strips which are inclined upwardly and rearwardly. The base portion has a U-shaped horizontal cross section which extends into and is bonded to the shoe sole. Some lateral strips are connected to medial strips to form inverted support loops behind the wearer's heel. Other lateral and medial strips have free upper ends which are curved toward each other in a transverse direction, and their stiffness deters lateral movement of the ankle to reduce a risk of ankle injury.

13 Claims, 2 Drawing Sheets

SHOE AND ANKLE SUPPORT THEREFOR

BACKGROUND OF THE INvENTION

This invention relates to shoes, and particularly to shoes and ankle supports which are constructed to reduce the risk of ankle injuries. The invention is applicable primarily to athletic shoes, since many athletic activities raise a significant risk of ankle injury. In the past, there have been numerous proposals for supplemental ankle supports for shoes, but the present inventor considers such proposals to be less effective than the shoe and ankle support member of the present invention. Typical examples of prior ankle supports are found in the following United States patents:

| | |
|---|---|
| Smadbeck et al. | 325,280 |
| Pugsley | 487,492 |
| Horn et al. | 522,371 |
| Posner | 555,328 |
| Krieger | 1,192,433 |
| Meyers | 1,522,256 |
| Redden | 1,548,172 |
| Posner | 1,586,698 |
| Hilgert | 1,692,896 |
| Saitta | 2,634,515 |
| Lin et al. | 4,571,856 |
| O'Rourke et al. | 4,676,011 |
| Fuerst et al. | 4,947,560 |
| Bunch et al. | 4,989,350 |

SUMMARY OF THE INvENTION

In one respect, the invention involves a shoe provided with an ankle support member. The periphery of the shoe's upper is attached to the sole so that the upper and sole enclose the wearer's foot. The ankle support member is formed of a stiff resilient bendable material, and it has a base portion which is U-shaped in horizontal cross section so as to extend laterally of, behind, and medially of a heel of the wearer's foot. The ankle support member is provided with a plurality of lateral strips and a plurality of medial strips which have their lower ends attached to the base portion and are inclined upwardly and rearwardly. At least one of the lateral strips and at least one of the medial strips are connected together in a rear part of the shoe to form an inverted loop behind the wearer's heel; and, at least two of the strips are top strips which are located medially and laterally of the wearer's ankle where they extend higher than the heel strips. The heel and top strips have a stiffness which deters lateral movement of the ankle to reduce a risk of ankle injury.

Preferably, the ankle support member is located between inner and outer layers of the shoe upper, the base portion of the ankle support member extends into and is bonded to the sole, and the base portion and strips are integrally formed of a single piece of sheet material. Some strips, denoted "top strips," extend higher than the heel strips. The top strips on the medial side of a wearer's foot have upper portions which are curved in a lateral direction; and the top strips on the lateral side of the wearer's foot have upper portions which are curved in a medial direction.

In another respect, the invention involves an ankle support member per se, formed of a body of stiff resilient bendable material including a base portion which is U-shaped in horizontal cross section so as to extend laterally of, behind, and medially of a heel of the wearer's foot. The ankle support member has a plurality of lateral strips and a plurality of medial strips. At least two of the strips are heel strips which are located medially and laterally of a wearer's heel, and at least two of the strips are top strips which are located medially and laterally of the wearer's ankle. The top strips extend vertically higher than the heel strips. The heel and top strips have a stiffness which deters lateral movement of the ankle to reduce a risk of ankle injury.

Preferably, the base portion and strips are integrally formed of a single piece of sheet material, the base portion is bonded to a shoe sole, and the strips are parallel to each other in transverse projection. The top strips located medially of the wearer's foot have upper portions which are curved in a lateral direction, and the top strips which are located laterally of the wearer's foot have upper portions which are curved in a medial direction.

DETAILED DESCRIPTION

Figure 1:
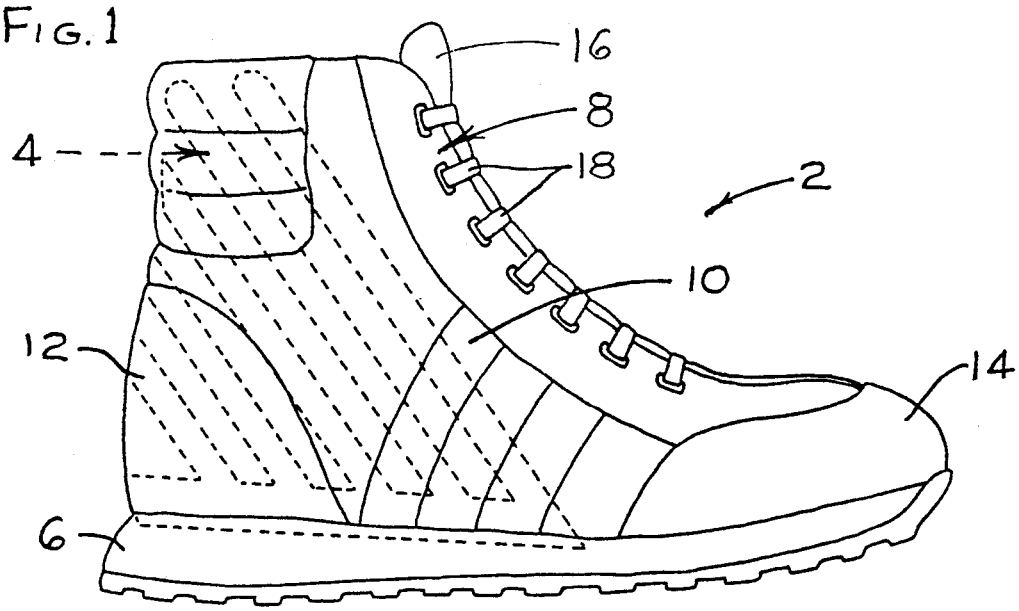
FIG. 1 is a side view of a shoe constructed according to the invention.
Figure 2:
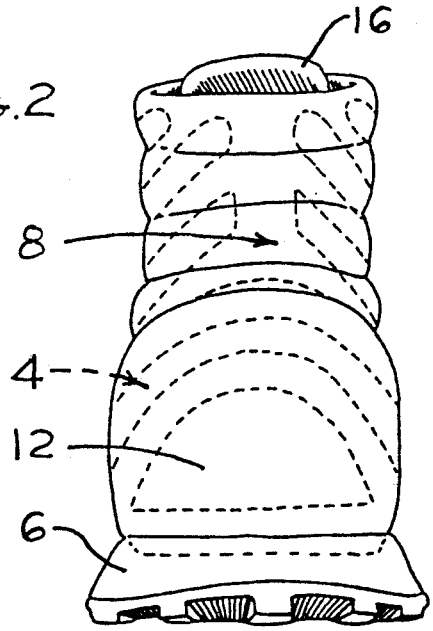
FIG. 2 is a rear view of the shoe of FIG. 1.

FIGS. 1 and 2 show a conventional athletic shoe 2 which has been modified to incorporate therein the ankle support member 4 according to the invention. As is customary in such footwear, the shoe has a molded elastomeric sole 6, and an upper 8 which has its periphery attached to the sole so that the foot is enclosed by the upper and sole. The upper is formed in a conventional manner and it includes a vamp section 10, a heel portion 12, and a toe portion 14. In the regions which lie laterally of, behind, and medially of the wearer's heel, the upper 8 has inner and outer layers. The shoe has a tongue 16, laces 18, and other components which may be conventional in the art as exemplified by the following patents, the contents of which are incorporated herein by reference:

| | |
|---|---|
| Lin et al. | 4,571,856 |
| O'Rourke et al. | 4,676,011 |
| Fuerst et al. | 4,947,560 |
| Bunch et al. | 4,989,350 |

The present invention involves the utilization of a novel ankle support member 4 in a shoe to provide extra strength and support to reduce the risk of ankle injuries. The ankle support member or frame 4 is located between the inner and outer layers of the upper 8. It starts at the arch or medial side of the foot and shoe, and it extends around the heel to the opposite or lateral side of the foot and shoe.

Figure 3:
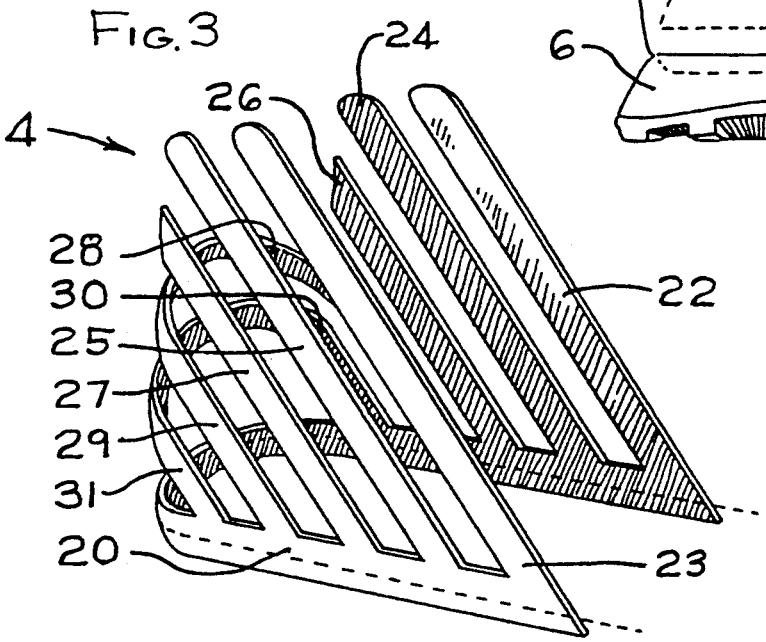
FIG. 3 is a perspective view of an ankle support member according to the invention.
Figure 4:
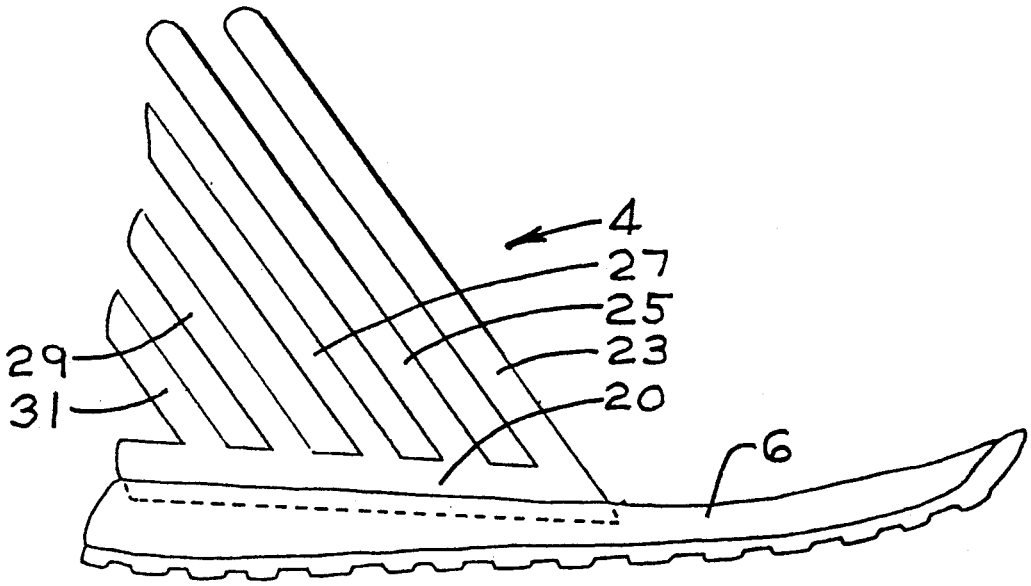
FIG. 4 is a side view of the ankle support member affixed to a shoe sole.
Figure 5:
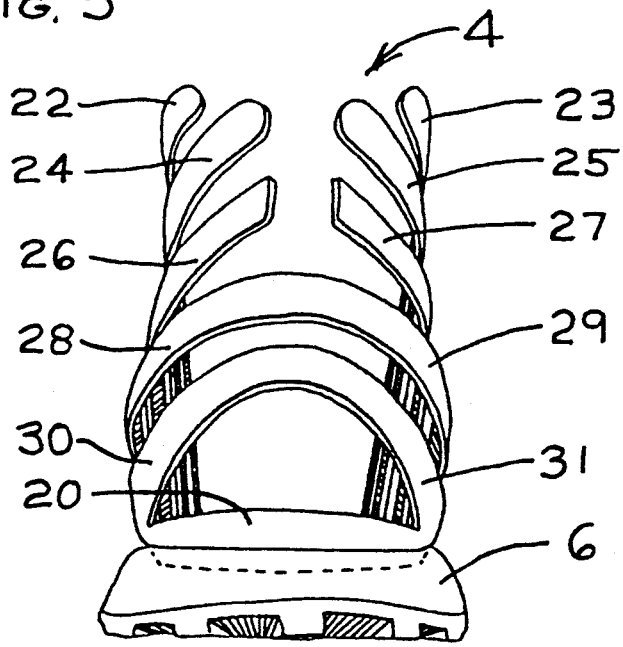
FIG. 5 is a rear view of the ankle support member and shoe sole of FIG. 4.

The construction of the ankle support member 4 is more conveniently seen by referring to FIGS. 3, 4, and 5. It is a one-piece construction, preferably formed of a single piece of sheet material which is stiff, resilient, and bendable. Suitable materials are conventional hard rubber or the recently publicized electron-cured rubber developed by Silverman.

In the lower regions of the ankle support member, there is a base portion 20 which is U-shaped in horizontal cross section so it extends laterally of, behind, and medially of the wearer's heel. A plurality of finger-like strips 22–31 are integral with the base portion and they extend upwardly from the base portion at uniform angles. As shown in FIG. 4, they are inclined upwardly and rearwardly, and they are parallel in transverse projection. The preferred angle of inclination is about from 50° to 70° from a horizontal plane. The lateral strips are identified by the reference numerals 23, 25, 27, 29, and 31, and the medial strips are identified by the reference numerals 22, 24, 26, 28, and 30.

As can be seen in FIGS. 4 and 5, the lowermost portion of the base 20 of the ankle support member extends into and is bonded to the sole 6. This bonding can be performed when the sole is molded or during a subsequent operation in order to provide a strong anchoring hold.

Lateral strips 29 and 31 and medial strips 28 and 30 are referred to as heel strips because they are connected together in a rear part of the shoe to form inverted heel loops which lie behind and wrap around the wearer's heel. The top strips 22–27, however, have free upper ends. They extend vertically higher than the heel strips 28–31, and they have a stiffness that deters lateral movement of the ankle to reduce the risk of ankle injury. As can be seen best in FIG. 5, the medial top strips 22, 24, and 26 have their upper portions curved inwardly in a lateral direction, and the lateral top strips 23, 25, and 27 have their upper portions curved inwardly in a medial direction. The physical properties of the top strips are such that they give a comfortable leeway, providing the wearer with a reasonable degree of flexing and forward and backward motion of the foot and ankle.

Although only one embodiment of the invention has been shown, persons familiar with the art will realize that it may take many other forms. Accordingly, it is emphasized that the invention is not limited only to the disclosed embodiment, but is embracing of other configurations which fall within the spirit of the following claims.

I claim:

1. A shoe adapted to be worn on a foot of a wearer, comprising, a sole for underlying the wearer's foot, an upper for receiving the wearer's foot, said upper having its periphery attached to the sole so that the upper and the sole enclose the wearer's foot, an ankle support member formed of a stiff resilient bendable material including a base portion which is U-shaped in horizontal cross section so as to extend laterally of, behind, and medially of a heel of the wearer's foot, said ankle support member having a plurality of lateral strips and a plurality of medial strips, said lateral and medial strips having their lower ends attached to said base portion and being inclined upwardly and rearwardly, at least one of said lateral strips and at least one of said medial strips being heel strips which are connected together in a rear part of the shoe to form an inverted loop behind the wearer's heel, at least two of said strips being top strips which are located medially and laterally of the wearer's ankle and extend vertically higher than said heel strips, said heel strips and top strips having a stiffness which deters lateral movement of the ankle to reduce a risk of ankle injury.

2. A shoe adapted to be worn on a foot of a wearer, according to claim 1, wherein said strips are parallel to each other in transverse projection.

3. A shoe adapted to be worn on a foot of a wearer, according to claim 1, wherein said upper is formed of inner and outer layers in regions which lie laterally of, behind, and medially of the heel of the wearer's foot, said ankle support member being located between said inner and outer layers.

4. A shoe adapted to be worn on a foot of a wearer, according to claim 1, wherein said base portion of the ankle support member extends into and is bonded to said sole.

5. A shoe adapted to be worn on a foot of a wearer, according to claim 1, wherein the base portion and strips are integrally formed of a single piece of sheet material.

6. A shoe adapted to be worn on a foot of a wearer, according to claim 1, wherein said top strips which are located medially of a wearer's foot have upper portions which are curved in a lateral direction, and said top strips which are located laterally of a wearer's foot have upper portions which are curved in a medial direction.

7. A shoe adapted to be worn on a foot of a wearer, according to claim 1, wherein the ankle support member is formed of rubber.

8. An ankle support member for a shoe adapted to be worn on a foot of a wearer, comprising, a body of a stiff resilient bendable material including a base portion which is U-shaped in horizontal cross section so as to extend laterally of, behind, and medially of a heel of the wearer's foot, said ankle support member having a plurality of lateral strips and a plurality of medial strips, said lateral and medial strips having their lower ends attached to said base portion and being inclined upwardly and rearwardly, at least one of said lateral strips and at least one of said medial strips being heel strips, at least two of said strips being top strips which are located medially and laterally of the wearer's ankle and extend vertically higher than said heel strips, said heel and top strips having a stiffness which deters lateral movement of the ankle to reduce a risk of ankle injury.

9. An ankle support member according to claim 8 wherein at least two of the heel strips are connected together in a rear part of the shoe to form an inverted loop behind the wearer's heel.

10. An ankle support member according to claim 8 wherein said strips are parallel to each other in transverse projection.

11. An ankle support member according to claim 8 including a shoe sole to which said base portion of the ankle support is bonded.

12. An ankle support member according to claim 8 wherein the base portion and strips are integrally formed of a single piece of sheet material.

13. An ankle support member according to claim 8 wherein said top strips which are located medially of a wearer's foot have upper portions which are curved in a lateral direction, and said top strips which are located laterally of a wearer's foot have upper portions which are curved in a medial direction.

* * * * *